US005251960A

United States Patent [19]

Anderson

[11] Patent Number: 5,251,960

[45] Date of Patent: Oct. 12, 1993

[54] BASE FOR ROCKER/RECLINER

[76] Inventor: Patsy E. Anderson, P.O. Box 1801, Kilgore, Tex. 75662

[21] Appl. No.: 867,753

[22] Filed: Apr. 13, 1992

[51] Int. Cl.[5] ..... A47C 1/02

[52] U.S. Cl. ..... 297/344.12; 248/159

[58] Field of Search ..... 297/345, 130, 439; 248/159, 161, 157; 312/111; 5/8

[56] References Cited

U.S. PATENT DOCUMENTS

| | | | |
|---|---|---|---|
| 1,456,194 | 5/1923 | Rosenberg | 248/159 |
| 2,582,553 | 1/1952 | Mc Murtrie | 312/111 |
| 3,215,382 | 11/1965 | Stein | 297/130 |
| 3,343,871 | 9/1967 | Yates et al. | 297/323 |
| 3,851,917 | 12/1974 | Horstmann et al. | 297/345 |
| 4,786,107 | 11/1988 | Crockett | 297/330 |
| 4,852,939 | 8/1989 | Krauska | 297/71 |
| 4,946,222 | 8/1990 | Matson | 297/345 |
| 4,993,777 | 2/1991 | LaPointe | 297/325 |

*Primary Examiner*—Alexander Grosz
*Attorney, Agent, or Firm*—Dennis T. Griggs

[57] ABSTRACT

An auxiliary booster frame is added to a rocker/recliner chair to elevate the seat height. The chair has a platform base with platform side runners and slots formed in the bottom of the platform runners. The auxiliary booster frame has side runners which are conformed for nesting engagement with the platform runners. The booster runners fit under the platform runners and have topside slots aligned directly under the platform slots. Key wedges fit within the aligned slots and maintain the booster frame in alignment with the platform base. The auxiliary booster frame provides an inexpensive and reliable way of raising the chair to make it easier for people to get into and out of the chair, and requires no moving parts or electrical connections.

5 Claims, 2 Drawing Sheets

BASE FOR ROCKER/RECLINER

FIELD OF THE INVENTION

This invention relates generally to chairs for partially disabled persons, and more particularly to apparatus to make it easier for people to lower or raise themselves into and out of a chair.

BACKGROUND OF THE INVENTION

Elevatable chairs have been known in the art for some time, and include elevatable invalid chairs. A variety of chairs have been proposed to aid persons (e.g. partially disabled) who cannot easily lower or raise themselves from a conventional chair, for example, a rocker/recliner with an 18 inch seat height. Often such chairs require electrical motors, thus must be plugged into an electrical socket to function. Some such powered chairs, while easy to get out of, are awkward to sit down on. Unpowered chairs of this type generally use springs which, especially when sitting down, are appropriate only for a narrow weight range and thus, for example, are not appropriate for two people of somewhat different weights.

Such chairs typically have power-assist lift mechanisms and are used by invalids o others requiring assistance in rising from a chair, for example, handicapped, elderly, or persons having joint stiffness.

OBJECTS OF THE INVENTION

From the foregoing discussion, it can be seen that the conventional chair for the partially disabled is relatively complex and expensive, and does not always provide adequate assistance, especially while the person is being seated.

Accordingly, the principal object of the present invention is to provide an inexpensive and reliable way of raising a chair to make it easier both for people to get into and to get out of the chair, while requiring no moving parts or electrical connections.

It is a further object of the present invention to provide a method and apparatus which can elevate a conventional rocker/recliner chair, for example, by about two inches.

Yet another object of this invention is to provide a method and apparatus which can make it easier for people to get out of, and especially to get into a chair, to avoid the problems caused by an invalid dropping the last few inches into a chair.

A further object of this invention is to provide a method and apparatus which can, for example, make it easier for two people of somewhat different body weights to get out of, and especially to get into a chair, to avoid the problem of being unable to gently lower both a heavy invalid and a light invalid into a chair.

Still another object of this invention is to provide an apparatus which can be prefabricated for a certain type of chair and can be easily field assembled and/or easily installed on a chair using only common tools, such as a screwdriver.

SUMMARY OF THE INVENTION

It has been found that a large number of people who have difficulty getting out of a conventional rocker/recliner chair can much more easily get out of and into the chair if the chair is raised generally one to four inches, preferably about two inches. It has further been found that this can be done conveniently and inexpensively by providing a booster assembly which can easily be added to a conventional rocker/recliner chair.

The invention includes a method of adding an auxiliary booster frame to a rocker/recliner chair which is equipped with a platform base with platform sides and gliders). Typically, the method encompasses fabricating an auxiliary booster frame, with the frame having side runner and auxiliary crossbars between the runners. The runners are shaped to fit under the platform sides and with the runners having runner topside slots which can be aligned directly under platform slots in the bottom of the platform sides. The runners also have bottom slots. The gliders are removed from the chair and placed in the runner bottom slots. Key wedges are placed in the runner topside slots, with the key wedges extending above the topside slots. The chair is the placed on top of the auxiliary booster frame with the key wedges extending into platform slots in the bottom of the platform sides. The auxiliary booster frame provides an inexpensive and reliable way of elevating the chair to make it easier for people to get into and out of the chair, with the auxiliary booster frame requiring no moving parts or electrical connections.

The invention also includes a structure which is a booster assembly for a rocker/recliner chair of a type having a platform base with platform sides, and originally with gliders fitting in slots in the bottom of the platform sides. The booster assembly includes an auxiliary booster frame, with the frame having runners shaped to fit under the platform sides. The runners have topside slots alignable directly under the platform slots in the bottom of the platform sides, and also have bottom slots. The runner bottom slots receive the gliders from the platform sides. Auxiliary crossbars rigidly mounted directly between the runners stabilize the booster frame and prevent relative motion between the runners. Key wedges are placed in the slots in the topsides of the runners, with the key wedges extending above the topside slots.

BRIEF DESCRIPTION OF THE DRAWINGS

Operational features and advantages of the present invention will be appreciated by those skilled in the art upon reading the detailed description which follows with reference to the attached drawings, wherein.

DESCRIPTION OF THE PREFERRED EMBODIMENTS

Figure 1:
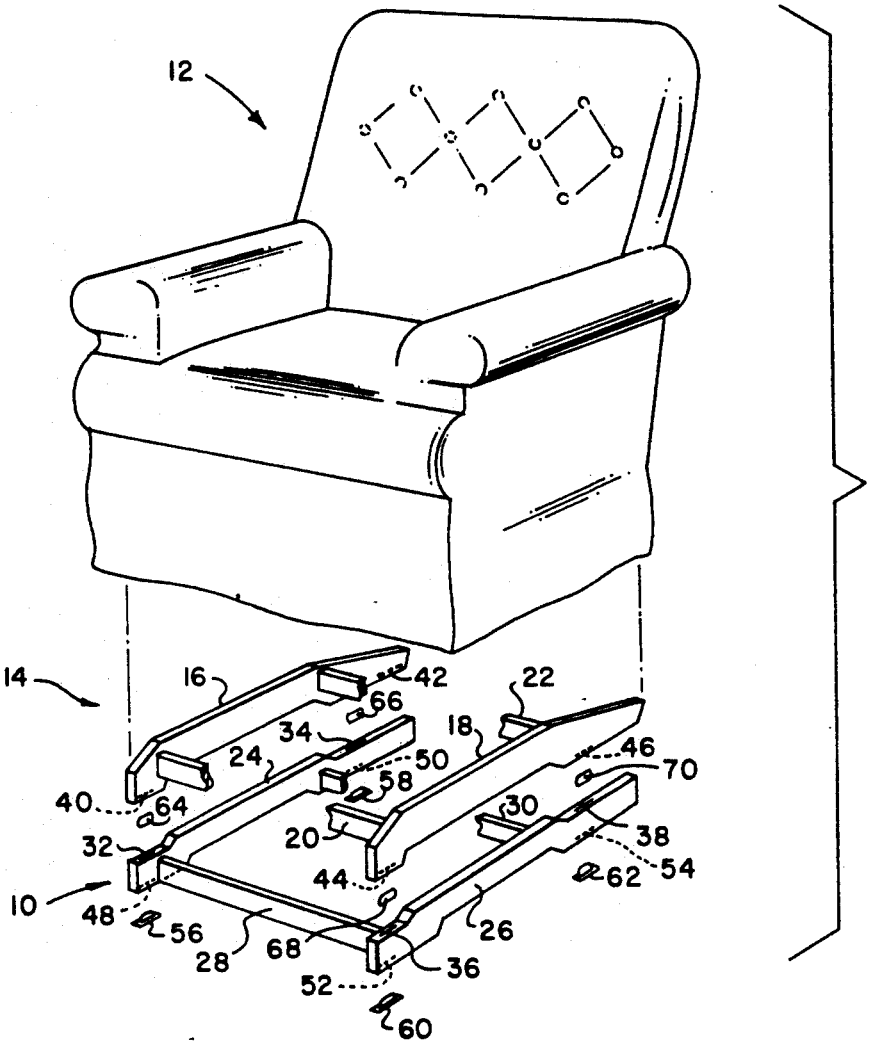
FIG. 1 is an exploded perspective view of an auxiliary booster frame and a rocker/recliner chair.

In the description which follows, like parts are indicated throughout the specification and drawings with the same reference numerals, respectively. The drawings are not necessarily to scale and the proportions of certain parts have been exaggerated to better illustrate details of the invention.

Figure 2:
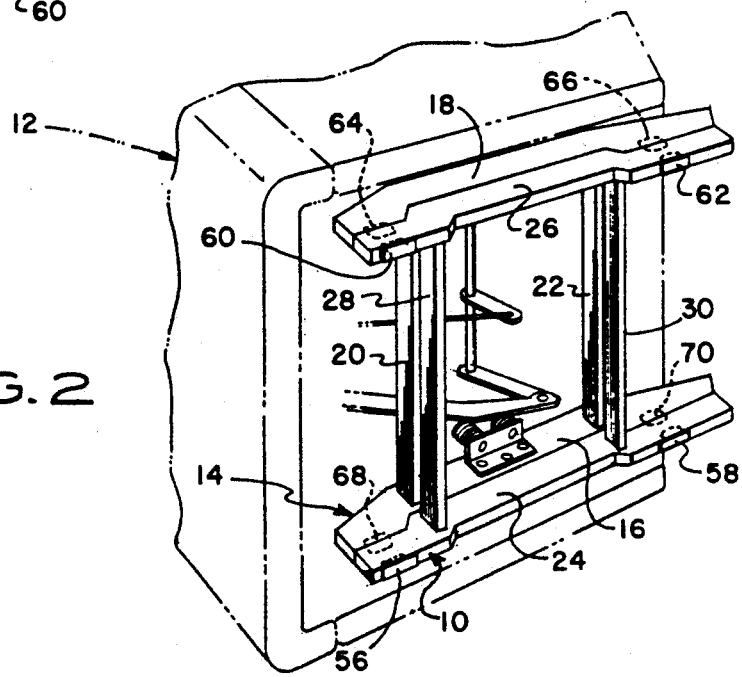
FIG. 2 is a bottom perspective view of an auxiliary booster frame-assembled to the bottom of a rocker/recliner.
Figure 3:
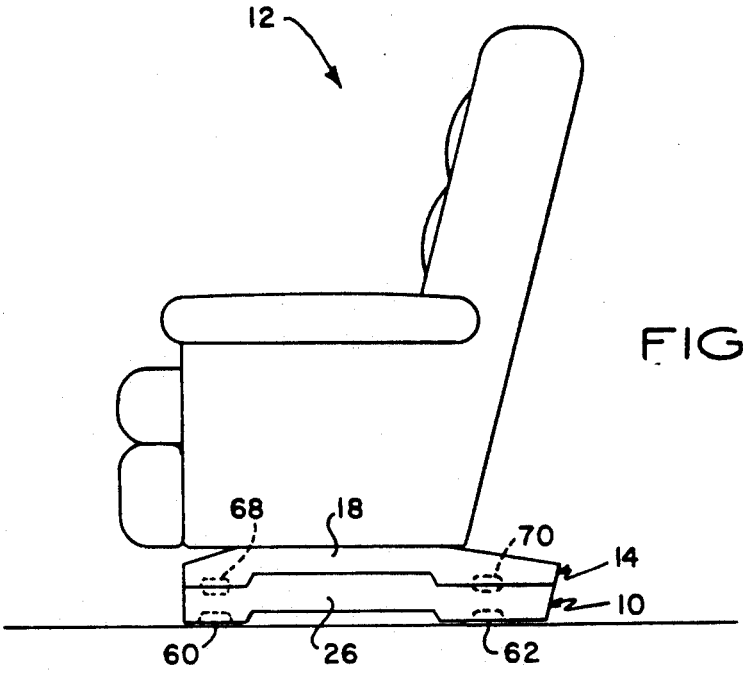
FIG. 3 is a side elevation view of an auxiliary booster frame assembled to a rocker/recliner chair.

FIGS. 1, 2 and 3 illustrate an auxiliary booster frame 10 and a conventional rocker/recliner chair 12. The rocker/recliner chair 12 has a platform base 14, with the base 14 having platform sides 16, 18 which are stabilized by platform crossbars 20, 22. The platform base 14 rests on the auxiliary booster frame 10, thus elevating the seating height of the chair 12 by about two inches. The auxiliary booster frame 10 has side runners 24, 26 which are stabilized by auxiliary crossbars 28, 30. The runners 24, 26 have topside slots 32, 34, 36, 38 are alignable directly under platform slots 40, 42, 44, 46 formed in the bottoms of the platform sides 16, 18. The side runners 24, 26 also have runner bottom slots 48, 50, 52, 54 in which gliders 56, 58, 60, 62 fit. Key wedges 64, 66, 68, 70 (see FIG. 1) maintain the platform base 14 positioned above the auxiliary booster frame 10.

Figure 4:
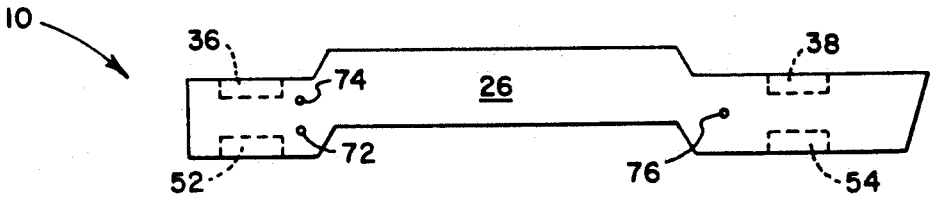
FIG. 4 is a side elevation view of a runner of an auxiliary booster frame.
Figure 5:
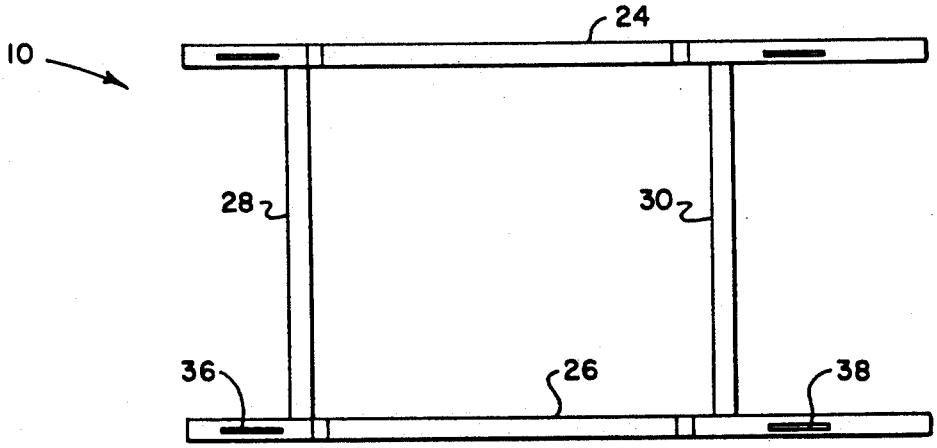
FIG. 5 is a plan view of an auxiliary booster frame.

FIGS. 4 and 5 show the side runners 24, 26 of the auxiliary booster frame 10, and also illustrate the auxiliary crossbars 28, 30 rigidly mounted on the runners. The crossbars 28, 30 maintain the runners in parallel spaced relation and prevent relative motion. In this embodiment, two front screw holes 72, 74 are formed in side runner 26 for attaching the front auxiliary crossbar 28, and only one screw hole 76 is formed in side runner 24 for attaching the back auxiliary crossbar 30. The corresponding holes in the side runners thus provide easy differentiation of the front crossbar 28 from the back crossbar 30 during assembly. The front screw holes and the back screw holes can both be countersunk on the outside, and the outside of the runners can thus easily be identified by the countersunk screw holes during assembly.

The ease with which an assembled auxiliary booster frame 10 can be added to a conventional rocker/recliner chair 12 can easily be seen with reference to FIGS. 1-5. As the first step, the gliders 56, 58, 60, 62 are removed from the chair 12 and placed in the runner bottom slots 48, 50, 52, 54. Typically, there are four such gliders. The key wedges 64, 66, 68, 70 are then be placed in the topside slots 32, 34, 36, 38 of the side runners 24, 26. The key wedges 64, 66, 68, 70 are preferably of a size that approximately half of each key wedge 64, 66, 68, 70 extends above the topside slots 32, 34, 36, 38 of the side runners 24, 26. The chair 12 is then be placed on top of the auxiliary booster frame 10 with the runner topside slots 32, 34, 36, 38 aligned directly under the platform slots 40, 42, 44, 46 and with the key wedges 64, 66, 68, 70 extending into the platform slots 40, 42, 44, 46.

Thus, it can be seen that the auxiliary booster frame 10 provides an inexpensive and reliable way of elevating seat height of the chair 12 to make it easier for people to get into and out of the chair 12. Moreover, the auxiliary booster frame 10 requires no moving parts or electrical connections.

Figure 6:
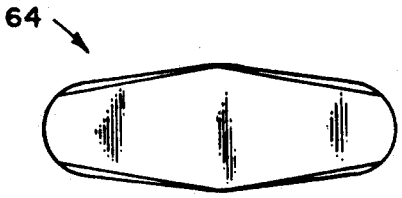
FIG. 6 is a side elevation view of a key wedge.
Figure 7:
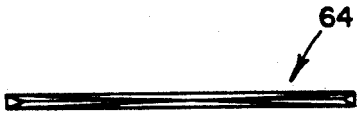
FIG. 7 is a plan view of a key wedge.

A typical key wedge 64 is shown enlarged in more detail in FIGS. 6 and 7. While the key wedges 64, 66, 68, 70 could, for example, be metal, preferably the key wedges 64, 66, 68, 70 are plastic, and are generally of a configuration where about half of each key wedge fits into a platform slot (e.g. 40) in the platform base 14 of the rocker/recliner, and the other half of that key wedge fit into a runner topside slot (e.g. 32) of the auxiliary booster frame 10.

The auxiliary booster frame 10 is wood, and is preferably finished (e.g. stained) to match the finish of the platform base 14. The auxiliary booster frame is approximately two inches high. The key wedges are constructed of resilient material such as plastic or aluminum.

Although the invention has been described with reference to a specific embodiment, the foregoing description is not intended to be construed in a limiting sense. For example, the embodiment shown is with a certain type of conventional rocker/recliner (e.g. a "Lazy Boy"), but can easily be used with other conventional platform chairs. In addition, the key wedge has been shown to be of a thin configuration to fit in the same slot which was originally used for the gliders of one type of rocker/recliner. Other types of chairs may have different slots and/or holes in which the gliders mount, and the term "key wedge" is intended to cover any key, a portion of which fits in a slot or hole formed in the existing platform base with the other portion of the key wedge fitting in a similar slot or hole in the top of the auxiliary booster frame, such that the key wedge maintains the auxiliary booster frame aligned with regard to the platform base. The original slot or hole from which the glider is removed can be modified, e.g. enlarged or a new slot can be added at a different location. Various modifications to the disclosed structure and method, as well as alternative applications, will be suggested to persons in the art by the foregoing specification and illustrations. It is therefore contemplated that the appended claims will cover any such modifications, applications, or embodiments which fall within the true scope of the invention.

What is claimed is:

1. A method of adding an auxiliary booster frame to a chair, the chair being of a type which has a platform base with platform sides and gliders which can be removed from platform slots in the bottom of said platform sides of said chair, said method comprising:

providing an auxiliary booster frame, said frame having side runners and having auxiliary crossbars attached to said runners, with said runners being shaped to fit under said platform sides and with said runners having topside slots alignable directly under platform slots in the bottom of said platform sides, and with said runners also having runner bottom slots;

removing said gliders from said chair and placing said gliders in said runner bottom slots of said runners;

placing key wedges in the topside slots of said runners, said key wedges extending above said topsides slots; and placing said chair on top of said auxiliary booster frame with said key wedges extending into said platform slots of said platform sides to elevate said chair using no moving parts or electrical connections, whereby said auxiliary booster frame provides an inexpensive and reliable way of raising the chair to make it easier for people to get into and out of the chair.

2. A method of adding an auxiliary booster frame to a rocker/recliner chair, the chair being of a type which has a platform base with stained wooden platform sides and gliders which can be removed from platform slots in the bottom of said platform sides of said chair, said method comprising:

providing an auxiliary booster frame, said frame having wooden side runners with said wooden runners stained to match chair platform sides and with said frame having auxiliary crossbars between said runners, with said runners being about 2 inches high and being shaped to fit under said platform sides and with said runners having topside slots alignable directly under platform slots in the bottom of said platform sides, and with said runners also having runner bottom slots;

removing said gliders from the platform slots in the bottom of said platform sides of said chair and placing said gliders in said runner bottom slots; and placing thin plastic key wedges in the runner topside slots, said key wedges extending above the runner topside slots; and placing said chair on top of said auxiliary booster frame with said key wedges extending into said slots in the bottom of said platform sides to elevate said chair using no moving parts or electrical connections, whereby said auxiliary booster frame provides an inexpensive and reliable way of raising the chair about 2 inches to make it easier for people to get into and out of the chair.

3. A booster assembly for a rocker/recliner chair having a platform base with platform sides, said booster assembly comprising:

an auxiliary booster frame, said frame having side runners, said runners being shaped to fit under said platform sides, and with said runners having topside slots alignable directly under platform slots in the bottom of said platform sides, and with said runners also having runner bottom slots, said runner bottom slots being capable of receiving said gliders from said chair, said frame also having auxiliary crossbars rigidly mounted directly between said runners to substantially prevent relative motion between said runners; and key wedges disposed in the topside slots of said runners, said key wedges extending above the topside slots, with the booster assembly having no moving parts or electrical connections, whereby gliders can be removed from said chair and placed in the runner bottom slots of said runners, and whereby the chair can be placed on top of said auxiliary booster frame with said key wedges extending into platform slots in the bottom of said platform sides, and whereby said auxiliary booster frame provides an inexpensive and reliable way of raising the chair to make it easier for people to get into and out of the chair.

4. The booster assembly of claim 5, wherein said key wedges are made of plastic.

5. The booster assembly of claim 5, wherein said auxiliary booster frame is made of wood.

* * * * *